United States Patent [19]

Czipri

[11] Patent Number: 4,809,634

[45] Date of Patent: Mar. 7, 1989

[54] POP UP CLEAT

[76] Inventor: John Czipri, 229 Palm Island SW., Clearwater, Fla. 34630

[21] Appl. No.: 192,906

[22] Filed: May 12, 1988

[51] Int. Cl.[4] ..... B63B 21/04

[52] U.S. Cl. ..... 114/218

[58] Field of Search ..... 114/218, 230, 343, 199; 410/82, 83, 107, 111; 24/115 GK, 136 K

[56] References Cited

U.S. PATENT DOCUMENTS

| | | | |
|---|---|---|---|
| 3,102,708 | 9/1963 | Crain | 248/361 |
| 3,126,859 | 3/1964 | Bigelow | 114/218 |
| 4,270,478 | 6/1981 | Kafka et al. | 114/218 |
| 4,354,445 | 10/1982 | Kafka et al. | 114/218 |
| 4,672,909 | 6/1987 | Sweetsir | 114/218 |

FOREIGN PATENT DOCUMENTS

| | | | |
|---|---|---|---|
| 635569 | 1/1935 | Fed. Rep. of Germany | 114/218 |

*Primary Examiner*—Sherman D. Basinger
*Assistant Examiner*—Edwin L. Swinehart
*Attorney, Agent, or Firm*—Harold D. Shall

[57] ABSTRACT

A pop up cleat having a base plate for receiving the cleat. The base plate has a pair of longitudinally spaced holes and the cleat has a pair of legs received in the holes. A cross pin connecting legs. A pair of coil springs urging the cleat to the pop up position with said springs connected between the cross pin and the base plate. A release pin and a spring cam acting between the release pin and the base plate. The spring cam being engageable with said cross pin to hold said cleat in its depressed position while depressing the release pin moves the spring cam so that the coil springs can force the cleat to its pop up position.

3 Claims, 4 Drawing Sheets

POP UP CLEAT

BACKGROUND OF THE INVENTION

This invention relates to cleats generally and more specifically to a cleat which has a depressed or concealed inoperative position and is actuable to pop up to an upright exposed position wherein it is operable as a cleat.

Cleats have for many years been in wide spread use on boats and other applications. These cleats are used to secure and have attached thereto ropes and lines for securing various devices such as a sail on a boat. A number of prior art patents have been related to the fact that an upstanding fixed cleat on a boat deck, for example, presents a hazard to someone walking thereon since they may trip over the same when the cleat is upright. Other objects can also become entangled in upright cleats. Therefore, it is desirable to have the cleat be concealed and, thereby out of the way when not in use, while still having a sturdy and rigid construction when it is operatively exposed and capable of use.

It is therefore desirable to have a base plate which is secured to the deck, which base plate receives the cleat in a depressed or concealed position and which assembly contains means for releasing the cleat to an upright or operative position wherein the cleat projects above the base plate and is operative to be utilized. A primary object of this invention is to eliminate such hazard that an upright unused cleat presents and to provide a cleat which can be retracted to an out-of-the-way position and which can be easily and quickly released to a projecting position for tiedown function.

SUMMARY OF THE INVENTION

The present invention provides a cleat which has a depressed or concealed position wherein it is spring loaded and is capable of being released so that it pops up under the spring load to an upright or operative position wherein it is suitable to have a rope or line secured thereto.

The present invention accomplishes the above with a rigid and strong structure so that when it is in its various positions it is very strong and durable while being capable of easy and rapid movement between its opposed positions.

BRIEF DESCRIPTION OF THE DRAWINGS

FIG. 7—7 showing the depressed position, FIG. 8—8 showing the raised position and FIG. 9—9 showing an intermediate position.

DETAILED DESCRIPTION

Figure 1:
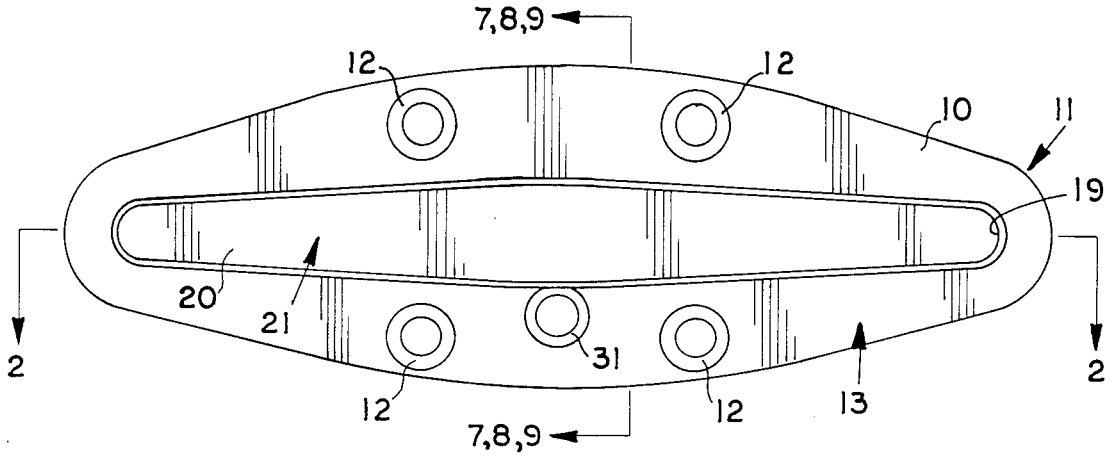
FIG. 1 is a plan view of the pop up cleat of this invention including the deck plate that holds the cleat in its various positions.

Referring now to the drawings, a base plate of the pop up cleat assembly 11 is shown at 10. Referring to FIG. 1, the base plate 10 has four countersunk attaching holes 12 adapted to receive bolts passing through the deck of the vessel to thereby rigidly secure the cleat assembly 11 to the deck; the deck (not shown) having an opening suitably receiving the assembly 11 and providing an edge around the opening to which the base plate is secured.

Figure 2:
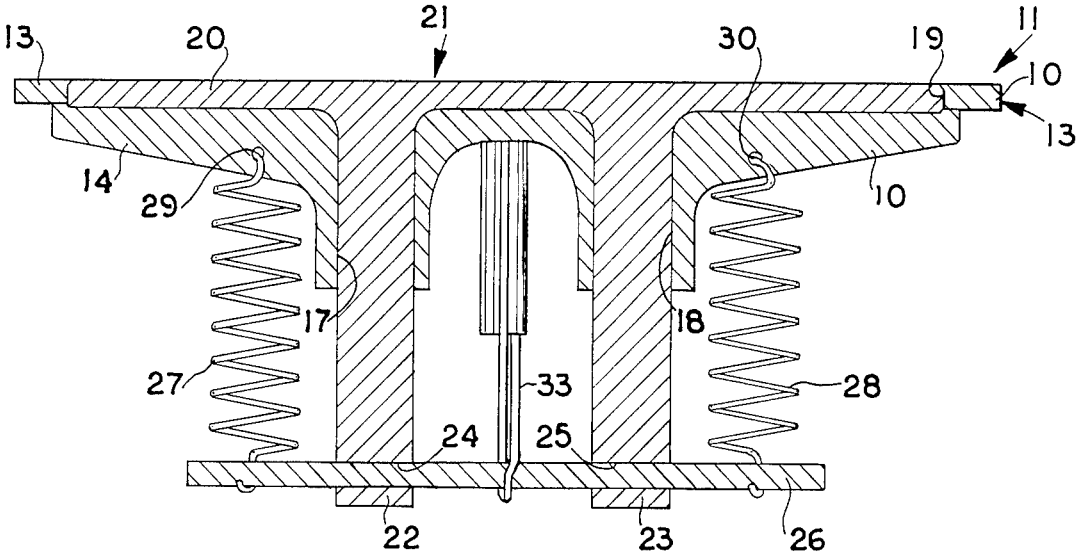
FIG. 2 is a sectional view taken substantially along the line 2—2 in FIG. 1.

The base plate is of one piece construction and, as seen in FIGS. 2, 3, 4 and 7–9 has a peripheral flange 13 depending from which is a body portion 14. The body portion 14 has a pair of longitudinally spaced downwardly extending legs 15 and 16, which legs, as seen in FIG. 2, each respectively contain a vertically extending opening 17 and 18 therethrough.

As seen in FIGS. 1 and 2, the flange 13 of the base plate has a longitudinal opening 19 lying within the confines thereof. A cleat 21 is carried by the base plate 10. More particularily the cleat has a horizontal elongated portion 20 which is received within the opening 19 when the cleat in its depressed position as seen in FIGS. 1 and 2. A pair of longitudinally spaced cleat legs register respecively with and are respectively received in the openings 17 and 18 in the body portion 14 of the base plate 10 for relative reciprocating movement. The longitudinal spacing of the legs 22 and 23 in substantially wide to lend strength to the cleat 21.

The lower end of the legs 22 and 23 have aligned longitudinally extending openings 24 and 25, respectively, which openings have pressed thereinto a cross pin 26 which further adds strength and rigidity to the cleat 21. The ends of the cross pin 26 extend longitudinally of the cleat legs 22 and 23 and have clipped thereto the lower ends of left spring 27 and right spring 28. The upper end of springs 27 and 28 are respectively received in openings 29 and 30 formed in the body portion 14 of the base plate 10 while two springs are shown, other numbers can be used, for example one spring of suitable strength located centrally between the legs 22 and 23.

Figure 3:
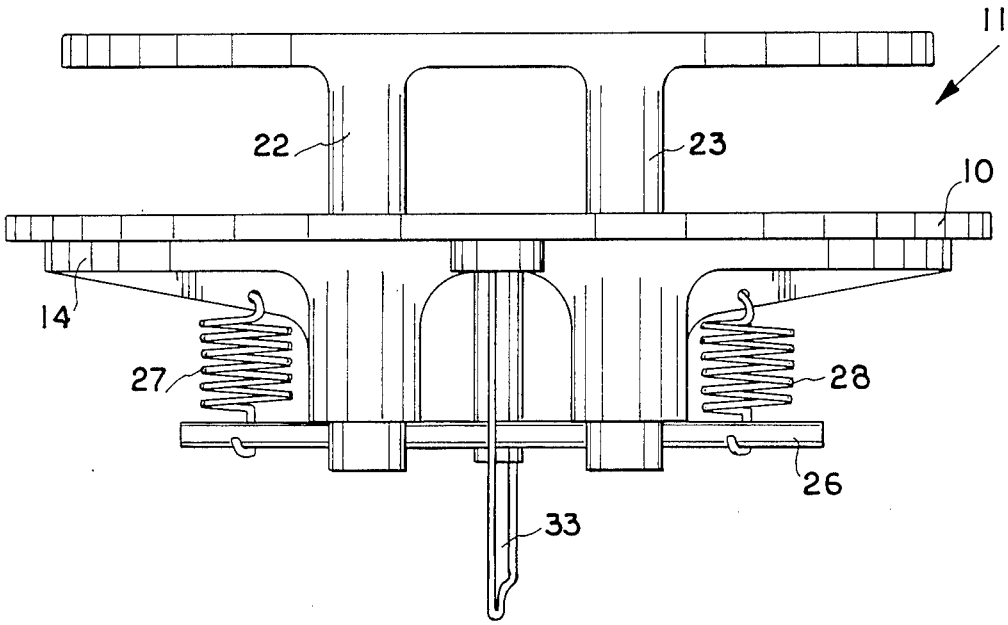
FIG. 3 is a front elevational view with the cleat in the popped-up position.
Figure 4:
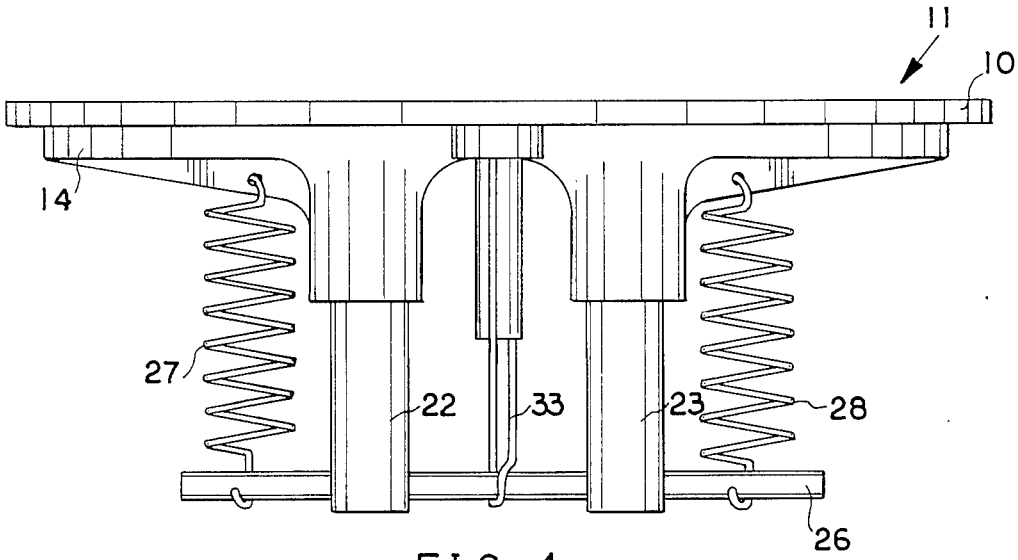
FIG. 4 is a view like FIG. 3 with the cleat in the depressed or concealed position.
Figure 5:
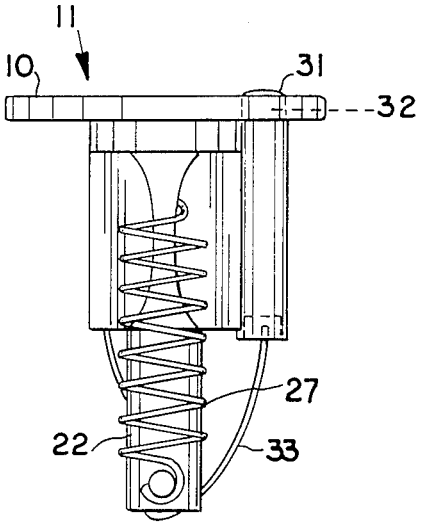
FIG. 5 is an end view from the left end of FIG. 1 with the cleat in the depressed position.
Figure 6:
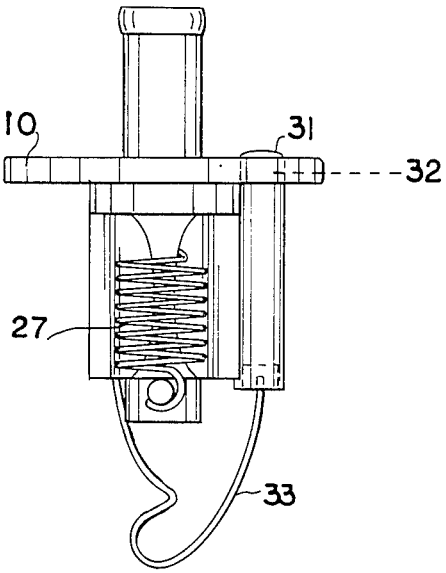
FIG. 6 is a end view like FIG. 5 but with the cleat in the popped-up position.

The springs 27 and 28 act to cause the cleat 21 to pop up to its position of FIGS. 3 and 6 from its depressed position as seen in FIGS. 2, 4 and 5.

Figure 9:
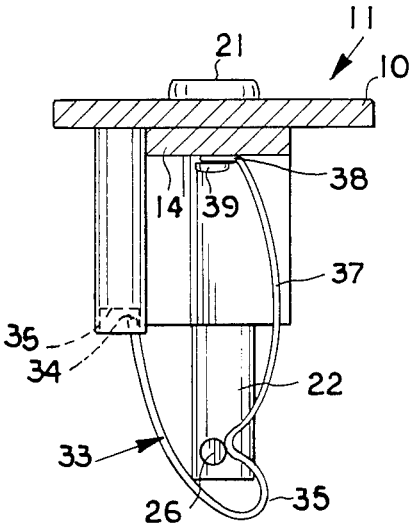
FIGS. 7, 8 and 9 are cross sectional views taken along the lines 7—7; 8—8; and 9—9 in FIG. 1.
Figure 7:
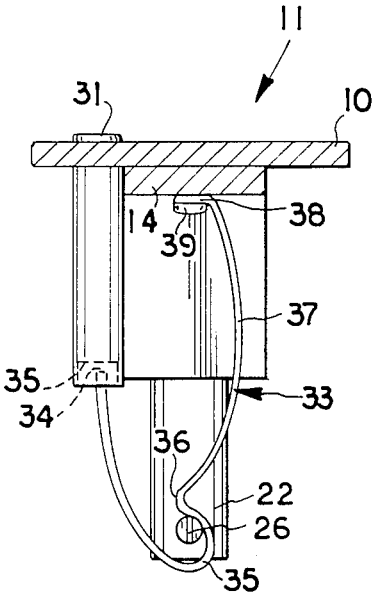
Figure 8:
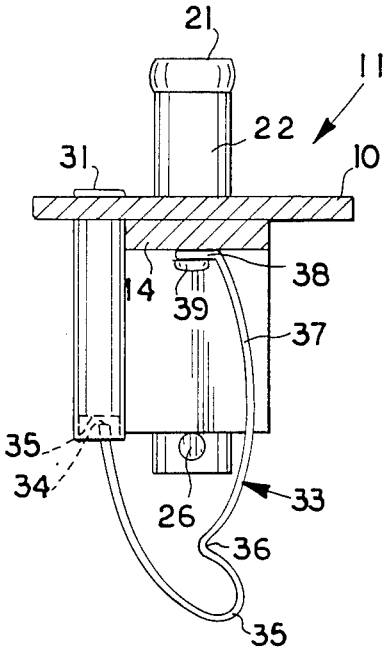

Means are provided to hold the cleat 21 in its depressed position and to allow it to pop up to its operative position. More particularly a release pin 31 is vertically positioned and telescopically received in an opening 32 in the base plate shown in dotted lines in FIGS. 5 and 6. A spring cam 33, whose operation can be most clearly seen with reference to FIGS. 7, 8 and 9 has one of its ends 34 received in a pocket 35 formed in the lower end of the release pin 31. As seen in FIGS. 7–9, the spring cam extends downwardly from the pin 31 and curves to the right, whereupon it forms a reverse loop leading to a detent shoulder 36. The spring cam 33 then bends to the right and extends upwardly at 37 to its right top end 38 which is screwed by a screw 39 to the body portion 14.

The spring cam 33 constantly biases the release pin 31 upwardly to the position shown in FIGS. 7 and 8. In FIG. 7, the cleat (not seen) is completely depressed and the detent shoulder of the spring cam 33 is holding same in such position. In FIG. 9, the release pin 31 (not seen) has been manually depressed and the cross pin has moved up the cam under the urging of the springs 27 and 28 to an untenable intermediate position shown for illustration only. In FIG. 8, the cleat 21 is completely up due to the urging of the springs 27 and 28.

To depress the cleat, one merely applies a downward load on the top thereof, as by stepping on it or manually depressing it until the cross pin moves past the detent shoulder 36 which holds the cross pin and the cleat 21 in their depressed positions.

Although the above description relates to a presently preferred embodiment, numerous modifications may be made therein without departing from the spirit of the invention as defined in the following claims.

What is claimed is:

1. A pop up cleat assembly having a depressed position and a pop up position comprising, (a) an elongated base plate having a longitudinal slot extending for a portion of its length, (b) said base plate having a pair of longitudinally spaced vertically, extending openings therein, (c) a longitudinally extending cleat extending for the length of said slot and receivable therein, (d) said cleat including a pair of depending legs with one leg being received in each of said vertically spaced openings, (e) pin means connecting said legs, (f) spring means connecting said pin means to said base plate for constantly urging said cleat outwardly of said slot, (g) a release pin, (h) a spring cam connected to said release pin and to said base plate, (i) said spring cam constantly urging said release pin vertically upwardly, and having a cam shoulder intermediate its ends, (j) said spring cam engaging said pin means at such times as said cleat is in its depressed position and said cam shoulder holding said pin means and said cleat in their depressed position, and (k) depression of said release pin allows said cam shoulder to move from its engaging position of said pin means and allowing said spring means to urge said cleat to its pop up position.

2. A device according to claim 1 wherein said spring means are a pair of coil springs with one spring being disposed longitudinally outwardly of each of said depending legs.

3. A device according to claim 1 wherein said cam shoulder re-engages said pin means upon manual depression of said cleat and pin means.

* * * * *